US005900344A

United States Patent [19]

Silence et al.

[11] Patent Number: 5,900,344

[45] Date of Patent: May 4, 1999

[54] CARRIER COMPOSITION AND PROCESSES THEREOF

[75] Inventors: Scott M. Silence, Fairport; John A. Creatura, Ontario; Bing R. Hsieh; Ronald F. Ziolo, both of Webster; Richard W. Ellis; K. Derek Henderson, both of Rochester; Bernard A. Kelly, Ontario, all of N.Y.

[73] Assignee: Xerox Corporation, Stamford, Conn.

[21] Appl. No.: 08/923,256

[22] Filed: Sep. 4, 1997

[51] Int. Cl.[6] ..... G03G 9/107; G03G 9/113

[52] U.S. Cl. ..... 430/106.6; 430/108; 430/137

[58] Field of Search ..... 430/106, 108, 430/137, 106.6

[56] References Cited

U.S. PATENT DOCUMENTS

| | | | |
|---|---|---|---|
| 4,233,387 | 11/1980 | Mammino et al. | 430/137 |
| 4,810,611 | 3/1989 | Ziolo et al. | 430/106.6 |
| 4,935,326 | 6/1990 | Creatura et al. | 430/108 |
| 4,937,166 | 6/1990 | Creatura et al. | 430/108 |
| 5,700,615 | 12/1997 | Silence et al. | 430/108 |

*Primary Examiner*—John Goodrow
*Attorney, Agent, or Firm*—John L. Haack

[57] ABSTRACT

A carrier comprising core particles with a coating thereover comprised of at least one polymer, a conductive colorant, and a stabilizer compound.

20 Claims, No Drawings

CARRIER COMPOSITION AND PROCESSES THEREOF

REFERENCE TO COPENDING AND ISSUED PATENTS

Attention is directed to commonly owned and assigned U.S. Pat. No. 4,810,611, entitled "Developer Compositions with Coated Carrier Particles having Incorporated Therein Colorless Particles", wherein there is illustrated carrier particles with coatings containing copper iodide.

Attention is directed to commonly owned and assigned U.S. Pat. No. 5,700,615 filed Jan. 27, 1997, entitled "Coated Carrier Particles", there is illustrated carrier particles with coatings containing copper iodide; U.S. Ser. No. 08/876,099 (D/96700) filed Jun. 13, 1997, entitled "Coated Carriers", there is illustrated a composition comprised of a strontium ferrite core and thereover a mixture of a first and second polymer, and wherein the first polymer contains a conductive component, and the second polymer contains copper iodide, and wherein the first and second polymer coating weight is from about 5 to about 25 weight percent; and U.S. Ser. No. 08/876,100 (D/97072) filed Jun. 13, 1997, entitled "Carrier Coating Processes", there is illustrated a process comprising: blending core particles with a first coating resin or resin mixture to produce a first blend; heating the resulting first blend to produce first coated particles; blending the resulting first coated particles with a second coating resin or resin mixture to form a second blend; and heating the second blend to afford second or twice coated particles.

The disclosures of each the above mentioned patents and copending applications are incorporated herein by reference in their entirety.

BACKGROUND OF THE INVENTION

The present invention is generally directed to electrostatographic carrier compositions and processes for stabilizing the triboelectric charge properties and the conductivity properties of the carrier compositions over extended periods of time and under highly variable humidity conditions. More specifically, the present invention is directed to carrier compositions comprising a core with a coating thereover comprised of at least one polymer, a conductive component such as a colorant or conductive pigment; and a stabilizer compound, wherein the triboelectric charge properties and the conductivity properties of the coated carrier particles remain constant over time and under variable humidity conditions, whether the carrier composition is in use as a developer or is in storage or transport.

The composition and processes of the present invention enable, for example, carrier and developer compositions exhibiting high resistance to environmental degradation and variation, for example, oxidation or humidity, and high stability of the carrier or developer compositions when eventually used after extended periods in storage or in transport.

The prior art discloses methods of preparing coated carriers and processes for controlling the tribocharging and conductivity properties of the partially coated conductive carrier cores with electropositive or electronegative polymers, for example, as disclosed in U.S. Pat. No. 5,015,550 to Creatura et al. U.S. Pat. No. 5,236,629, to Mahabadi et al., discloses submicron polymer/carbon black composites particles prepared by suspension polymerization techniques and their use in preparing conductive magnetic brush carriers by powder coating processes. Also of interest are U.S. Pat. Nos. 5,385,796, and 5,120,628, which disclose admixtures of a conductive component, such as copper iodide, and polymers for use in electrophotoreceptor devices.

Dry polymer coating processes for carrier particles are known in the art, such as U.S. Pat. Nos. 3,590,000 (Mammino, et al.), U.S. Pat. No. 4,233,387 (Mammino, et al.), U.S. Pat. No. 4,935,326 (Creatura, et al.), U.S. Pat. No. 4,937,166 (Creatura, et al.), and U.S. Pat. No. 5,002,846 (Creatura, et al.).

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith as it is these values that enable continued constant developed images of high quality and excellent resolution.

Additionally, carrier particles for use in the development of electrostatic latent images are described in many patents including, for example, U.S. Pat. No. 3,590,000. These carrier particles can be comprised of various cores, including steel, with a coating thereover of fluoropolymers, and terpolymers of styrene, methacrylate, and silane compounds. Past efforts have focused on the attainment of coatings for carrier particles for the purpose of improving development quality, and also to permit particles that can be recycled, and that do not adversely effect the imaging member in any substantial manner. A number of these coatings can deteriorate rapidly, especially when selected for a continuous xerographic process where the entire coating may separate from the carrier core in the form of chips or flakes; and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coating resides in fluctuating triboelectric charging characteristics, particularly with changes in relative humidity. The aforementioned modification in triboelectric charging characteristics provides developed images of lower quality, and with background deposits.

In U.S. Pat. No. 4,233,387, there is illustrated coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent are suitable for their intended purposes, the conductivity values of the resulting particles are not constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the present invention, the conductivity of the resulting carrier particles can be substantially constant, and moreover, the triboelectric values can be selected to vary significantly, for example, from less than −40 microcoulombs per gram to +40 microcoulombs per gram.

There is illustrated in U.S. Pat. Nos. 4,937,166 and 4,935,326, carrier containing a mixture of polymers, such as two polymers, not in close proximity in the triboelectric series. Moreover, U.S. Pat. No. 4,810,611, discloses that there can be added to carrier coatings colorless conductive metal halides in an amount of from about 25 to about 75 weight percent, such halides including copper iodide, copper fluoride, and mixtures thereof. In the '611 patent, the conductivity ranges are considered relatively narrow, and the carrier tribo charge is not believed to be of a wide range, which disadvantages are overcome, or minimized with the present invention.

The aforementioned references are incorporated in their entirety by reference herein.

There has been sought an inexpensive, efficient and environmentally efficacious carrier compositions, method for their preparation, and imaging processes thereof which afford high stability and therefore high performance and high reliability coated carrier and developers which are resistant to high humidity or changes in ambient humidity conditions, particularly coated carriers and developers containing a conductive additive, for example, copper iodide.

The aforementioned and other advantages are achievable with the compositions s and processes of the present invention.

SUMMARY OF THE INVENTION

Embodiments of the present invention, include:

overcoming, or minimizing deficiencies of prior art carrier compositions and processes, by providing carrier compositions and processes for stabilizing the coated carrier compositions against aging and environmental degradation;

providing a carrier composition comprising a core with a coating thereover comprised of at least one polymer, a conductive component, and a stabilizer compound, wherein the triboelectric charge properties and the conductivity properties of the coated carrier particles remain constant over extended time periods and under variable humidity conditions;

providing an imaging process comprising: providing polymer coated carrier a core with a coating thereover comprised of at least one polymer, a conductive colorant, such as a pigment, and a stabilizer compound; mixing the polymer coated carrier with a toner comprising a polymeric resin and a pigment to form a developer; and developing with the developer a latent image formed on a photoconductive imaging member; wherein the polymer coated carrier and developer have triboelectric charge and conductivity properties that are resistant to degradation, or are substantially unaffected by, oxidation and humidity;

providing processes for stabilizing polymer coated iron containing carrier compositions against environmental and age related deterioration comprising: mixing a conductive pigment, at least one coating resin, and a stabilizer compound; and coating the resulting mixture onto the surface of iron containing carrier core particles, wherein the resulting coated carrier has triboelectric charge and conductivity properties that are resistant to degradation, or unaffected by, oxidation and humidity.

DETAILED DESCRIPTION OF THE INVENTION

The compositions and processes of the present invention are useful in many electrostatographic applications, for example, in xerographic printers and copiers, where developers are required to operate under environmentally stressful conditions, for example, high or variable humidity, and perform reliably in a consistent fashion over extended periods of time, for example, in a continuous printing operation for from about 12 hours to about 2 months, and up to two years, and including stable developer performance after the developer has been stored for long periods of time prior to use.

In embodiments, the present invention provides carrier compositions comprising a core with a coating thereover comprised of at least one, and in embodiments preferably one polymer, a conductive component, and a stabilizer compound, wherein the triboelectric charge properties and the conductivity properties of the coated carrier particles remain substantially constant over time and under variable humidity conditions;

In embodiments, the present invention provides an imaging process comprising: providing polymer coated carrier a core with a coating thereover comprised of at least one polymer, a conductive component, or additive, and a stabilizer compound; mixing the polymer coated carrier with a toner comprising a polymeric resin and a conductive or non conductive pigment to form a developer; and developing with the developer a latent image formed on a photoconductive imaging member; wherein the polymer coated carrier and developer have triboelectric charge and conductivity properties that are resistant to degradation, and are substantially unaffected by, oxidation and humidity;

In embodiments, the present invention provides preparative processes for stabilizing polymer coated iron containing carrier compositions against environmental and age related deterioration comprising: mixing a conductive component, at least one coating resin, and a stabilizer compound; and coating the resulting mixture onto the surface of iron containing carrier core particles, wherein the resulting coated carrier has triboelectric charge and conductivity properties that are resistant to degradation, and substantially unaffected by, oxidation and humidity.

Although not wanting to be limited by theory, the high stability and resistance of the carrier and developer compositions of the present invention are believed to be attributable, in whole or in part, to the presence and activity of the stabilizer compound.

The stabilizer compound can be an alkaline compound, an antioxidant compound, an anticorrosion compound, and mixtures thereof. It is understood that there is considerable overlap in, for example, the specification, and utility of the aforementioned classes of stabilizer compounds. Thus, species of the stabilizer compounds from one of the aforementioned categories will frequently be classified or contained in more than one of the above categories, because of their electrochemical properties. Sodium silicate is an example of a compound which satisfies the chemical functional criteria of an alkaline compound, an antioxidant compound, or an anticorrosion compound. The stabilizer additive is present for example, in an amount of from about 0.1 to about 10 weight percent, and preferably of from about 0.5 to about 5 weight percent, and the conductive component is present in amounts of from about 5 to about 90 weight percent, and preferably of from about 10 to about 85 weight percent based on the total weight of coating materials.

Alkaline compounds include organic or inorganic compounds with a pH of from about 7.5 to about 12, such as for example, salts of carboxylic acid compounds, like sodium acetate and sodium benzoate, hindered heteroaromatic bases, such as 2,6-di-t-butyl pyridine, Group IA and IIA alkaline metal and alkaline earth salts of hydroxides, and alkoxides with from 1 to about 20 carbon atoms, like sodium ethoxide, and mixtures thereof.

Antioxidant compounds are known and include, for example, hindered phenols, hindered amine carboxylates, such as dimethyl 2,6-pyridine dicarboxylate, hindered amines, such as N,N-diphenyl-1,4-phenylene-diamine, triarylamines, and bis(triarylamines), such as tetramethyl-tolyl-biphenyidiamine, metallocenes, including ferrocenes, phosphonates, and heterocyclic compounds containing non-nucleophilic nitrogen atoms, including 2-(4-biphenyl-6-phenyl)benzoxazole, and mixtures thereof. Antioxidants include known food grade, rubber, and plastic antioxidant compounds, such as butylated hydroxytoluene(BHT) and the like hindered phenol compounds and hydroquinone compounds, reference also for example, U.S. Pat. No. 5,614,479, and reference cited therein.

Anticorrosion compounds can be known ferrous, non-ferrous, and alloyed metal corrosion inhibiting compounds and protectants, and include organic and inorganic compounds, such as for example, silicates, borates, nitrates, molybdates, phosphates, phosphonates, and the like, and mixtures thereof, and more specifically, sodium silicate, sodium metaperborate, sodium hydrogen phosphate, dimethyl methyl phosphonate, dimethyl n-butyl phosphonate, and the like.

The core material selected for the carrier particles can be, for example, unoxidized iron, steel, ferrites, and mixtures thereof. The diameter of the carrier particles can be from about 30 microns to about 300 microns, and preferably from about 65 to about 100 microns in volume average diameter.

The polymer used to coat the carrier core particles can be a thermoset or thermoplastic polymer, and mixtures thereof. The polymer coating weight employed is from about 0.1 to about 5, and preferably from about 1 to about 3 weight percent based on the weight of the weight of the core particles to be coated.

The triboelectric charge imparted to the carrier upon typical charging in a two component development apparatus is stable and can for example, be between −40 microcoulombs per gram and +40, or from −35 to +35 microcoulombs per gram, and the conductivity of the carrier is stable and can be between from about $10_{-6}$ to about $10_{-15}$ mho-cm$^{-1}$, and more specifically, from about $10^{-7}$ to about $10^{-14}$ mho-cm$^{-1}$. The triboelectric charge and conductivity properties remain substantially unchanged in a relative humidity of from about 30 to 100 percent for an extended time of for example, about 1 hour to about 2 years.

The conductive component can be any pigment or mixture of pigments which are capable of imparting the desired conductivity properties to coated carrier core particles when used in combination with the aforementioned stabilizing compound and polymer or copolymer coating resin, and which conductive pigments are not substantially negatively affected by the oxidative effects of oxygen or other oxidizing agents nor by hydrolysis, hydrate formation, hydrogen bonding, and related processes associated with reaction or interaction with ambient water molecules afforded by elevated humidity conditions. Examples of suitable conductive components are conductive pigments and include, but are not limited to, carbon black, metal oxides such as tin oxide, metals, metal amalgams or alloys, metal nitrides, and metal halides. In embodiments, a preferred conductive pigment is copper iodide of the formula CuI. Conductive pigment particles selected for use in the present invention can have an average particle size of from about 100 nanometers or less to 100 microns or greater, it being readily understood by those of ordinary skill in the art that smaller conductive particles are generally preferred from a conductivity perspective, although the cost and availability of the smaller sized conductive particles must be considered against those of large average size particle materials. Conductive pigment particles with average particles sizes of from about 0.1 to about 10 microns, when cooper iodide was selected, were found to provide desirable activity The coated carrier particles of the present invention and developer compositions thereof are highly resistant to oxidative agglomeration phenomena. Oxidative agglomeration phenomena is defined as the fusing of carrier particles together or to one another by oxidative reaction of the exposed iron or other metal on the surface of one carrier particle induced by an oxidation promoting agent on the surface of a second carrier particle. The subsequent reaction forms a chemical bridge or physical connection between the carrier particles which is difficult to mechanically break. Oxidative agglomeration phenomena is conveniently measured by placing a carrier sample in an environment of high relative humidity and, optionally, elevated temperature, which accelerates the process, and leaving the material undisturbed for a period of time, for example, several weeks. At the end of that period, when sufficient time has passed for the chemical reaction to occur, the carrier is passed through a vibrating metal screen with a screen opening size of between the diameter of the carrier and approximately twice the diameter of the carrier. The weight of the material that passes through the screen and the weight of the material that remains on top of the screen are measured, and the percentage, by weight, of the carrier which is fused into agglomerates too large to pass through the screen is calculated. For example, for a carrier formulation of the present invention, this fraction may be small, preferably less than about 50 weight, more preferably less than 20 weight percent, and most preferably less than 1 percent. By comparison, using a carrier formulation which does not contain a stabilizer additive as illustrated herein, this fraction may be 100 weight percent.

The coated carrier particles are resistant to, or free from, deleterious effects of humidity on the triboelectric and conductivity charge properties. Thus, in embodiments, a carrier or developer of the present invention maintains its triboelectric charging properties and conductivity properties under extended exposure to high, for example from about 30 to about 100 relative percent humidity, or variable humidity conditions, whereas a similar carrier or developer composition which does not contain the aforementioned stabilizer compound exhibits rapid degradation of triboelectric and conductivity properties when exposed to the same humidity conditions as illustrated herein.

In embodiments, the initial conductivity and the operating conductivity, that is, after the coated carrier particles have been in use in a developer for a time, of the coated carrier particles of the present invention are, for example, of from about $10^{-6}$ to about $10^{-15}$ mho-cm$^{-1}$, and possess a triboelectric charge, for example, of from about −40 to about +40 microcoulombs per gram.

The coating resin or resins used in forming the coated carrier can be one or more polymers or copolymers, for example, of from about 2 to about 10 polymers, and which polymers or copolymers can be thermoplastic polymers, thermoset polymers, and mixtures thereof, and wherein the polymers preferably contain few acidic functional groups, that is, the coating resin is a poor proton source, and the coating resins are preferably free of acidic functional groups. The thermoplastic polymer can be, for example, a styrene-butadiene copolymer, a styrene-acrylate copolymer, a methacrylate polymer or copolymer, such as polymethylmethacrylate or copoly(methylmethacrylatebutyl methacrylate), a fluorinated polymer or copolymer, and mixtures thereof. Suitable thermoset polymers include, for example, polyurethane, epoxy resins, polyesters, epoxy-polyester copolymers, polyester-polyurethane co-condensates, and the like materials, and mixtures thereof.

The present invention, in embodiments, encompasses developer compositions comprised of the coated carrier particles comprising a core with a coating thereover comprised of at least one polymer, a conductive pigment, and a stabilizer compound, and a toner composition comprised of toner resin particles and pigment particles.

Toner compositions can be prepared by a number of known methods, such as admixing and heating resin particles such as styrene butadiene copolymers, colorant particles such as magnetite, carbon black, or mixtures thereof, and cyan, yellow, magenta, green, brown, red, or mixtures thereof, and preferably from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel and then classified.

Illustrative examples of resins suitable for toner and developer compositions of the present invention include linear or branched styrene acrylates, styrene methacrylates, styrene butadienes, vinyl resins, including linear or branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITESE®; suspension polymerized styrene butadienes, reference U.S. Pat. No. 4,558,108, the disclosure of which is totally incorporated herein by reference.

In the toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, aniline blue, magnetite, or mixtures thereof carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances if desired, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

Colorant includes pigments, dye, mixtures thereof, mixtures of pigments, mixtures of dyes, and the like.

There can also be blended with the toner compositions external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the toners used in conjunction with the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are optionally present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonan ilide phenylazo-4'-chloro-2,5-dimethoxy acetoacetaniIide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The carrier particles used the aforementioned coating composition, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments about 175 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition used in conjunction with the coated carriers of the present invention can be prepared by a number of known methods as indicated herein including extrusion melt blending the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 25 microns, more preferably from about 8 to about 12 microns, and most preferably from about 5 to about 8 microns. Also, the toner compositions preferably possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions, in embodiments, of the present invention possess desirable narrow positive or negative charge distributions, optimal charging triboelectric values, preferably of from about 10 to about 40, and more preferably from about 10 to about 35 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Preparation of Acid Free Coated Carrier

A mixture of copper iodide (80% by weight, CuI) and the balance of a styrene-butadiene copolymer containing 87% styrene and 13% 1,3 butadiene with a number average molecular weight of about 16,000 and a weight average molecular weight of about 140,000 were extruded in an APV extruder operated at a barrel temperature of 400° F. diehead temperature of 350° F., at 26 percent load, a feedrate of 23 grams per minute, and at 150 revolutions per minute. The resulting powder was ground down to a volume median size of about 3.8 microns. The conductivity of the powder, measured as a pressed pellet, was $2.4\times10^{-5}$ ohm/cm. Next, 3.5 grams of the conductive powder was mixed by hand with 96.5 grams of a 100 micron spherical steel core (available from Nuclear Metals, Inc.) and placed in a relative humidity controlled environment for 2 weeks. During that time, no reaction was observed between the CuI and the steel core. Subsequent screening of the material, consisting of passing the material through an 84 mesh screen (210 micron opening), showed no core agglomeration.

In a control experiment, an 80 percent CuI loaded and no stabilizer polymethylmethacrylate (available from Soken Chemical), extruded and ground, showed evidence of steel oxidation under the same conditions and 100 percent core agglomeration, that is, a fused steel puck resulted.

A carrier was prepared by first mixing 91 grams of the copper iodide (80% by weight, CuI) and styrene-butadiene copolymer conductive powder mixture described above with 4,454 grams of 100 micron spherical steel core (available from Nuclear Metals) were mixed. The mixing was accomplished in an M5R blender with the following process conditions: blender speed of 50 rotations per minute and a blend time of 30 minutes. There resulted uniformly distributed and electrostatically attached polymer on the core as determined by visual observation. The core/polymer mixture was then processed in a rotary kiln furnace with the following process conditions: 30 minutes residence time, at 350° F. peak bead temperature. The CuI/styrene-butadiene copolymer conductive powder comprised 2 percent by weight of the resulting carrier. The resulting carrier conductivity, as determined by forming a 0.1 inch long magnetic brush of the carrier particles and measuring the conductivity by imposing a 10 volt potential across the brush was $5.6\times10^{-10}$ mho/cm, with a tribo determined by the known Faraday Cage process of −20.7 microcoulombs per gram which was obtained after a 10 minutes paint shake blend with a 9 micron average diameter simulated toner comprised of a 30 percent (by weight) gel content partially crosslinked polyester resin, described in U.S. Pat. No. 5,376,494, the disclosure of which is totally incorporated herein by reference, obtained by the reactive extrusion of a linear polyester resin (bisphenol-A propylene oxide fumarate polymer, available from Resanao Co. The carrier was placed in a relative humidity controlled environment for 2 weeks. During that time, no agglomeration of the carrier was observed after passing the carrier completely through an 84 mesh screen.

The triboelectric value of this carrier was monitored as a function of time in a 50 percent relative humidity environment and was found to be stable over a period of 53 days; that is, the triboelectric value of the carrier measured under the same conditions as the initial value measured above was −20.8 microcoulombs per gram after 10 days of exposure to an environment of 50% relative humidity; after 45 days the triboelectric value was −20.5 microcoulombs per gram; and after 63 days the triboelectric value was −21.9 microcoulombs per gram.

In a control experiment, carrier coated with 80 percent CuI loaded polymethylmethacrylate (available from Soken Chemical), and no stabilizer, was extruded and ground, and showed an initial triboelectric value of −6.4 microcoulombs per gram; after 14 days in 50 percent relative humidity the triboelectric value was reduced to −4.2 microcoulombs per gram; after 41 days in 50 percent relative humidity the triboelectric value was reduced to −0.1 microcoulombs per gram. This carrier, coated with coated 80 percent CuI loaded polymethylmethacrylate, does not exhibit stable triboelectric properties.

EXAMPLE II

Preparation of Alkaline Coated Carrier

Example I is repeated with the exception that a hindered amine additive, 2,6-di-t-butyl pyridine, in an amount of 5 weight percent with respect to CuI is included in the mixture to inhibit the disassociation of the CuI. The addition of the stabilizing alkaline additive can be accomplished, for example, either before melt mixing of the resin and other additives, such as during the preparation of the polymer, or during the melt mixing of the resin and other additives.

EXAMPLE III

Preparation of Antioxidant Containing Coated Carrier

Example I is repeated with the exception that an antioxidant stabilizer is included in the resin coating mixture for the purpose of suppressing the oxidation of the iron core by iodide($I^-$) ions arising from dissolution of CuI in adsorbed water. The addition of the antioxidant additive, also known in some instances as anticorrosion compounds or corrosion inhibitors, can be accomplished, for example, either before melt mixing of the resin and other additives, such as during the preparation of the polymer, or during the melt mixing of the resin and other additives.

EXAMPLE IV

Preparation of Antioxidant Containing Coated Carrier

A mixture of polymethylmethacrylate (19 percent by weight, Soken Chemical), CuI (80 percent by weight), and tetramethyl-tolyl-biphenyldiamine stabilizing additive (1 percent by weight based on the weight of the weight of the mixture of the conductive pigment and polymer) were extruded in an APV extruder: barrel temperature 400°0 F. diehead 350° F. 48 percent load, feedrate 10 gram per minute, and 150 revolutions per minute. The resulting powder was ground to a volume median size of 6.4 microns. The conductivity of the powder, measured as a pressed pellet was $3.4\times10^{-4}$ ohm/cm. The conductive powder was mixed with 100 micron sized spherical steel core, 3.5 percent by weight polymer, and placed in a relative humidity controlled environment for two weeks. During that time only a slight amount of steel oxidation was observed. Subsequent screening of the material showed a slight level of agglomeration, for example, about 15 percent of core agglomeration. This result is in counter distinction from a comparative Example wherein there was observed 100 percent core agglomeration in an similar powder which did not include the aforementioned tetramethyl-tolyl-biphenyldiamine stabilizing compound.

A carrier was prepared by first mixing 159 grams of the above mentioned polymethylmethacrylate (19 percent by weight, Soken Chemical), CuI (80 percent by weight), and tetramethyl-tolyl-biphenyidiamine (1 percent by weight) conductive powder with 4,386 grams of 100 micron spherical steel core (available from Nuclear Metals). The mixing was accomplished in an M5R blender with the following process conditions: blender speed of 50 rotations per minute and a blend time of 30 minutes. There resulted uniformly distributed and electrostatically attached polymer on the surface of the core as determined by visual inspection. The core/polymer mixture was then processed in a rotary kiln furnace with the following process conditions: 30 minutes residence time, at 500° F. peak bead temperature. The CuI/PMMA/tetramethyl-tolyl-biphenyldiamine polymer composite comprised 3.5 percent by weight of the resulting coated carrier. The resulting coated carrier conductivity, was determined by forming a 0.1 inch long magnetic brush of the carrier particles and measuring the conductivity by imposing a 10 volt potential across the brush was $5.3\times10^{-7}$ mho/cm, tribocharge was determined by the known Faraday Cage process and was −4.7 microcoulombs per gram obtained after 10 minutes paint shake blend with a 9 micron average diameter simulated toner comprised of a 30 percent (by weight) gel content partially crosslinked polyester resin, reference U.S. Pat. No. 5,376,494, the disclosure of which is totally incorporated herein by reference, obtained by the reactive extrusion of a linear polyester resin (bisphenol-A propylene oxide fumarate polymer, obtained from Resana Co.

EXAMPLE V

Preparation of Antioxidant Containing Coated Carrier

A mixture of polymethylmethacrylate (19 percent by weight, Soken Chemical), CuI (80 percent by weight), and ferrocene stabilizer(1 percent by weight) were extruded in an APV extruder: barrel temperature 400° F. diehead 350° F. 59 percent load, feedrate 14 gram per minute, and 150 revolutions per minute. The resulting powder was ground to a volume median size of 7.8 microns. The conductivity of the powder, as a pressed pellet, was $2.7\times10^{-4}$ ohm/cm. The powder was mixed with 100 micron sized spherical steel core, 3.5 percent by weight polymer, and placed in a relative humidity controlled environment for two weeks. During that time, only an intermediate amount of steel oxidation was observed. Subsequent screening of the material showed an intermediate level of agglomeration, about 50 percent of core agglomeration. This result is in contrast to a comparative Example wherein there was observed 100 percent core agglomeration in an similar powder which did not include the aforementioned ferrocene stabilizer compound.

A carrier was prepared by first mixing 159 grams of the above mentioned polymethylmethacrylate (19 percent by weight, Soken Chemical), CuI (80 percent by weight), and ferrocene (1 percent by weight) powder with 4,386 grams of 100 micron spherical steel core (available from Nuclear Metals) were mixed. The mixing was accomplished in an M5R blender with the following process conditions: blender speed of 50 rotations per minute and a blend time of 30 minutes. There resulted uniformly distributed and electrostatically attached polymer on the core as determined by visual observation. The core/polymer mixture was then processed in a rotary kiln furnace with the following process conditions: 30 minutes residence time, at 500° F. peak bead temperature. The CuI/PMMA/ferrocene polymer composite comprised 3.5 percent by weight of the resulting carrier. The resulting carrier conductivity, as determined by forming a 0.1 inch long magnetic brush of the carrier particles and measuring the conductivity by imposing a 10 volt potential across the brush was $5.3\times10^{-7}$ mho/cm, tribocharge determined by the known Faraday Cage process was −4.7 microcoulombs per gram obtained after 10 minutes paint shake blend with a 9 micron average diameter simulated toner comprised of a 30 percent (by weight) gel content partially crosslinked polyester resin, reference U.S. Pat. No. 5,376,494, the disclosure of which is totally incorporated herein by reference, obtained by the reactive extrusion of a linear polyester resin, a bisphenol-A propylene oxide fumarate polymer, obtained from Resana Co.

Other modifications of the present invention may occur to one of ordinary skill in the art based upon a review of the present application and these modifications, including equivalents thereof, are intended to be included within the scope of the present invention.

What is claimed is:

1. A carrier comprising core particles with a coating thereover comprised of at least one polymer, a conductive colorant, and a stabilizer compound.

2. A carrier in accordance with claim 1, wherein the stabilizer compound is selected from the group consisting of an alkaline compound, an antioxidant compound, an anticorrosion compound, and mixtures thereof, and wherein the colorant is a pigment.

3. A carrier in accordance with claim 1, wherein the core is selected from the group consisting of unoxidized iron, steel, and mixtures thereof.

4. A carrier in accordance with claim 1, wherein the polymer is a thermoset polymer, a thermoplastic polymer, or mixtures thereof.

5. A carrier in accordance with claim 1, wherein the conductive colorant is a pigment of copper iodide of the formula CuI.

6. A carrier in accordance with claim 1, wherein the coated carrier core particles are resistant to oxidative agglomeration phenomena.

7. A carrier in accordance with claim 1, wherein the coated carrier particles are resistant to, or free from, deleterious effects of humidity on the triboelectric and conductivity charge properties.

8. A carrier in accordance with claim 1, wherein of from about 2 to about 10 polymers are selected.

9. A carrier in accordance with claim 1, wherein the initial conductivity is of from about $10^{31\ 6}$ to about $10^{-15}$ mho-$cm^{-1}$, and the carrier triboelectric charge is from about −40 to about +40 microcoulombs per gram.

10. A developer comprised of the carrier particles of claim 1 and a toner composition comprised of toner resin particles and colorant particles.

11. A carrier in accordance with claim 1 wherein the polymer coating weight is of from about 0.1 to about 5 weight percent.

12. A carrier in accordance with claim 1 wherein the volume average diameter of the carrier particles is from about 30 microns to about 300 microns.

13. A carrier in accordance with claim 1 wherein the stabilizer is selected from the group consisting of salts of carboxylic acid compounds, 2,6-di-t-butyl pyridine, alkaline metal and alkaline earth salts of hydroxides and alkoxides, hindered phenols, dimethyl 2,6-pyridine dicarboxylates, N,N-diphenyl-1,4-phenylene-diamine, triarylamines, bis (triarylamines), metallocenes, phosphonates, heterocyclic compounds containing non-nucleophilic nitrogen atoms, silicates, borates, nitrates, molybdates, phosphates, and mixtures thereof.

14. A carrier in accordance with claim 1 wherein the stabilizer is present in an amount of from about 0.1 to about 10 weight percent, and wherein the conductive colorant is a pigment present in amounts of from about 5 to about 90 weight percent, based on the total weight of coating materials.

15. A carrier in accordance with claim 1 wherein the triboelectric charge imparted to the carrier is stable between about −40 microcoulombs per gram and about +40 microcoulombs per gram; wherein the conductivity of the carrier is stable between from about $10^{-6}$ to about $10^{-15}$ mho-cm$^{-1}$; and wherein said triboelectric charge and conductivity remain unchanged at a relative humidity of from about 30 to about 100 percent for a time of from about 1 hour to about 2 years.

16. A imaging process comprising:

providing the carrier of claim 1;

mixing the coated carrier with a toner comprising a polymeric resin and a colorant to form a developer; and developing with said developer a latent image formed on a photoconductive imaging member; wherein the coated carrier and developer have triboelectric charge and conductivity properties that are resistant to degradation, or are substantially unaffected by, oxidation and humidity.

17. A process in accordance with claim 16, wherein the stabilizer compound is selected from the group consisting of an alkaline compound, an antioxidant compound, an anticorrosion compound, and mixtures thereof, and wherein the conductive colorant is a pigment of copper iodide of the formula CuI.

18. A process in accordance with claim 16, wherein the coating resin is selected from the group consisting of thermoplastic polymers, thermoset polymers, and mixtures thereof, and wherein said polymers are free of acidic functional groups.

19. A process in accordance with claim 18, wherein the thermoplastic polymer is a styrene-butadiene copolymer, a styrene-acrylate copolymer, a methacrylate polymer or copolymer, a fluorinated polymer or copolymer, and mixtures thereof, and wherein the thermoset polymer is a polyurethane, an epoxy, a polyester, an epoxy-polyester, a polyester-polyurethane, and mixtures thereof.

20. A process comprising:

mixing a conductive pigment, at least one coating resin, and a stabilizer compound; and coating the resulting mixture onto the surface of a carrier core wherein the resulting coated carrier has triboelectric charge and conductivity properties that are resistant to degradation, or unaffected by, oxidation and humidity.

* * * * *